US010173119B2

(12) United States Patent
Muhammad

(10) Patent No.: US 10,173,119 B2
(45) Date of Patent: Jan. 8, 2019

(54) PUNCHING SHIELD WITH INDENTS FORMED ON A STRIKING SURFACE

(71) Applicant: Yusuf Alexander Muhammad, King George, VA (US)

(72) Inventor: Yusuf Alexander Muhammad, King George, VA (US)

( * ) Notice: Subject to any disclaimer, the term of this patent is extended or adjusted under 35 U.S.C. 154(b) by 312 days.

(21) Appl. No.: 15/283,700

(22) Filed: Oct. 3, 2016

(65) Prior Publication Data

US 2018/0093153 A1 Apr. 5, 2018

(51) Int. Cl.

| | |
|---|---|
| ***A63B 69/00*** | (2006.01) |
| ***A63B 69/20*** | (2006.01) |
| ***A63B 23/12*** | (2006.01) |
| ***A63B 69/26*** | (2006.01) |
| *A63B 71/00* | (2006.01) |

(52) U.S. Cl.

CPC ..... *A63B 69/20* (2013.01); *A63B 23/1209* (2013.01); *A63B 69/26* (2013.01); *A63B 71/0054* (2013.01); *A63B 2209/00* (2013.01)

(58) Field of Classification Search

None

See application file for complete search history.

(56) References Cited

U.S. PATENT DOCUMENTS 1,044,987 A * 11/1912 Campbell ..... A63B 69/0086 482/86
2,526,217 A * 10/1950 Gilman ..... A63B 69/345 473/444
3,396,969 A * 8/1968 Rosenfeld ..... A63B 69/345 473/444
3,427,021 A * 2/1969 Donato ..... A63B 69/20 473/441
3,759,515 A * 9/1973 Crooks ..... A63B 67/00 273/440
4,667,954 A * 5/1987 McCorkle ..... A63B 69/26 473/444
4,946,159 A * 8/1990 Jones ..... A63B 69/004 473/441
5,232,368 A * 8/1993 Morgia ..... A63B 69/20 273/DIG. 30
5,501,649 A * 3/1996 Queppet ..... A63B 69/004 434/247
6,141,807 A * 11/2000 Tapper ..... A47C 3/16 5/640
8,287,437 B1 * 10/2012 Rovere ..... A63B 69/004 473/444
8,555,429 B2 * 10/2013 Leach ..... A47K 3/127 4/572.1

(Continued)

*Primary Examiner* — Stephen R Crow

(74) *Attorney, Agent, or Firm* — Dunlap Bennett & Ludwig PLLC

(57) ABSTRACT

A punching shield is provided. The punching shield includes an outer casing and a padding disposed within the outer casing. The outer casing includes a front surface (striking surface), a rear surface opposite the front surface, and an angled surface running from an outer edge of the front surface to an outer edge of the rear surface. A plurality of protrusions extend from the angled surface and are radially disposed from the outer edge of the rear surface to the outer edge of the front surface. An indent is formed between a pair of protrusions, thereby forming a plurality of indents on the angled surface.

10 Claims, 3 Drawing Sheets

(56) References Cited

U.S. PATENT DOCUMENTS

| | | | | |
|---|---|---|---|---|
| 9,022,904 | B1 * | 5/2015 | Dorsey, III | A63B 69/004<br>482/83 |
| 9,616,310 | B2 * | 4/2017 | Manley | A63B 69/004 |
| 9,668,584 | B2 * | 6/2017 | Green | A47C 7/021 |
| 2006/0037143 | A1 * | 2/2006 | Green | A47C 7/021<br>5/653 |
| 2008/0061618 | A1 * | 3/2008 | DeSimone Lavigne | A47C 3/16<br>297/452.21 |
| 2009/0082179 | A1 * | 3/2009 | Le | A63B 69/004<br>482/88 |

* cited by examiner

PUNCHING SHIELD WITH INDENTS FORMED ON A STRIKING SURFACE

BACKGROUND OF THE INVENTION

The present invention relates to punching shields and, more particularly, to a punching shield with a plurality of indents.

A punching bag is a sturdy bag designed to be repeatedly punched. A punching bag is usually cylindrical, and filled with various materials of corresponding hardness. A punching shield is a padded handheld shield designed to be repeatedly punched. Punching shields and punching bags have a cylinder shaped hitting surface. Therefore, the punching shield or punching bag cannot properly act as an anatomical friendly surface when striking. The cylinder or square shapes limit the hand's capability to strike flush surfaces, which may cause injury.

As can be seen, there is a need for an improved punching shield that reduces the chances of injury.

SUMMARY OF THE INVENTION

In one aspect of the present invention, a punching shield comprises: an outer casing comprising: a front surface; a rear surface opposite the front surface, wherein the rear surface comprises a larger diameter than the front surface; an angled surface running from an outer edge of the front surface to an outer edge of the rear surface; and a plurality of protrusions extending from the angled surface and radially disposed from the outer edge of the rear surface to the outer edge of the front surface, wherein a plurality of indents are formed therebetween; and a padding disposed within the outer casing.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a multi-angle punching and striking shield. The present invention includes more anatomically-friendly striking surfaces, as it presents striking surfaces from various angles. Due to the indents formed along an outer edge of the shield, the user is able to strike from any angle and strike a flush surface of the shield.

Figure 1:
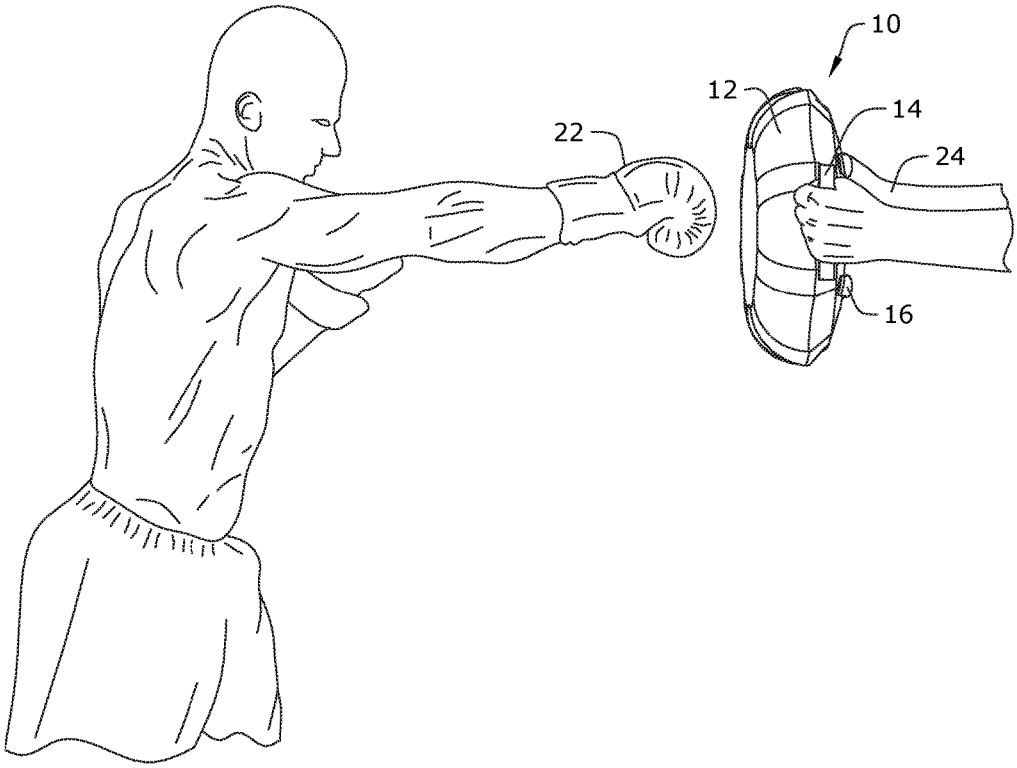
FIG. 1 is a perspective view of an embodiment of the present invention shown in use.
Figure 2:
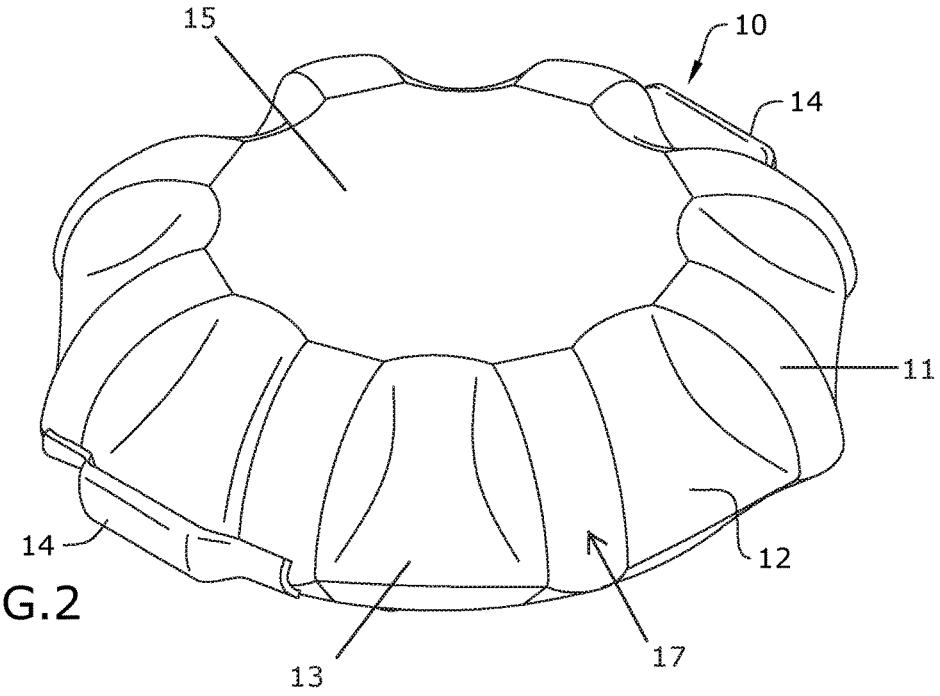
FIG. 2 is a top view of an embodiment of the present invention.
Figure 3:
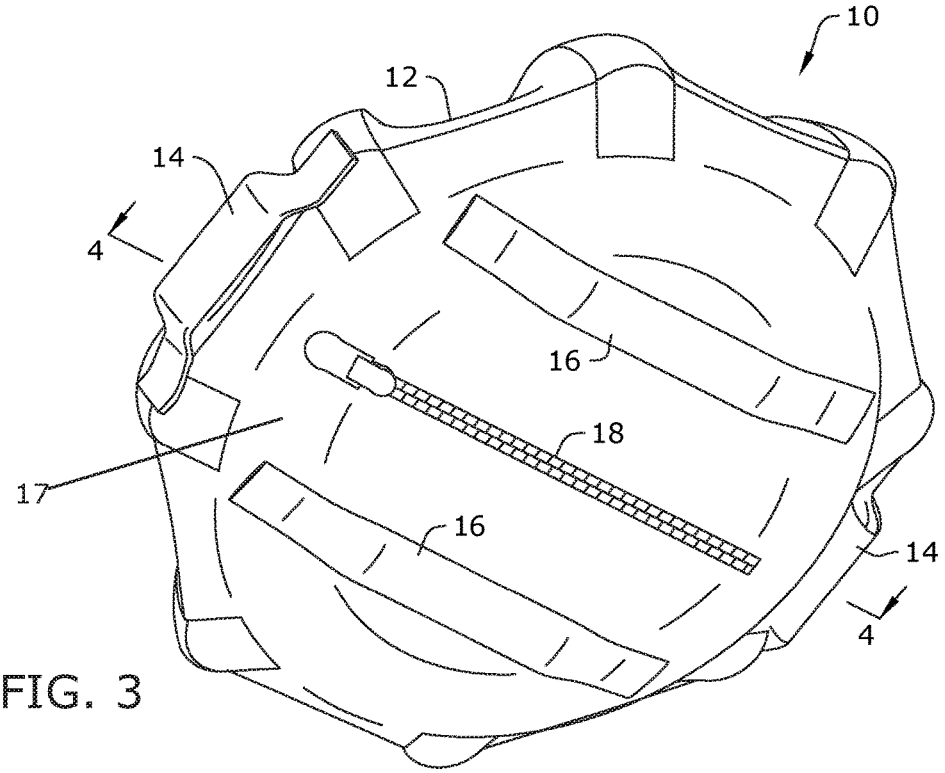
FIG. 3 is a bottom view of an embodiment of the present invention.
Figure 4:
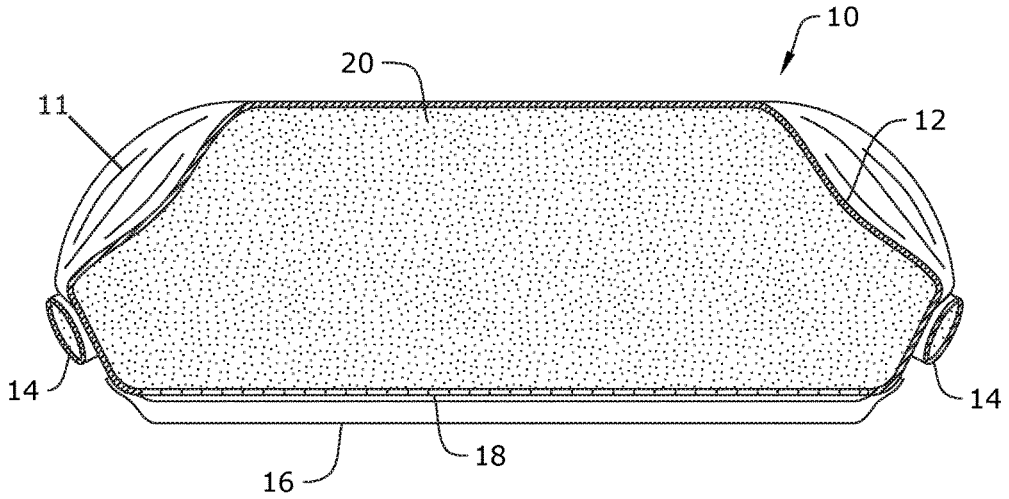
FIG. 4 is a section view of the present invention taken along line 4-4 in FIG. 3.

Referring to FIGS. 1 through 4, the present invention includes a punching shield 10. The punching shield 10 includes an outer casing 13 and a padding 20 disposed within the outer casing 12. The outer casing 13 includes a front surface 15 (striking surface), a rear surface 17 opposite the front surface 15, and an angled surface 19 running from an outer edge of the front surface 15 to an outer edge of the rear surface 17. A plurality of protrusions 11 extend from the angled surface 19 and are radially disposed from the outer edge of the rear surface 17 to the outer edge of the front surface 15. An indent 12 is formed between a pair of protrusions 11, thereby forming a plurality of indents 12 on the angled surface 19.

The indents 12 of the present invention may have a curved shape. Each of the indents 12 may have a half pipe shape of a half moon shape. For example, each indent 12 may include a first sidewall, a second sidewall and a base surface. The first sidewall and the second sidewall may form a curved concave shape from a top end to a bottom end and the base may include a curved concave shape from the first sidewall to the second sidewall. Due to the indents being radially disposed about the striking surface, the user 22 is able to strike from any angle and strike a flush surface of the shield 10.

In certain embodiments, the punching shield 10 may form a frusto conical shape. For example, the rear surface 17 includes a larger diameter than the front surface 15. The angled surface 19 is disposed about an entire circumference of the front and rear surfaces 15, 17. Further, the front surface 15 and the rear surface 17 may be substantially planar.

The punching shield 10 may include four, five, six, seven or eight protrusions 11. For example, the punching shield 10 may include eight protrusions 11 forming an octagon shape.

The present invention may further include a plurality of handle straps 14, 16. In certain embodiments, the outer edge of the rear surface 17 is angled towards the angled surface 19. A pair of side handle straps 14 may be secured to opposing sides of the outer edge of the rear surface 17. In certain embodiments, the present invention may include a pair of rear handle straps 16 secured to the rear surface 17. The handle straps 14, 16 allow trainers 24 to hold the punching shield 10 in different positions.

In certain embodiments, the outer casing 13 of the present invention may be made of leather. However, the outer casing 13 may also be made of synthetic or natural fibers woven together. The padding 20 of the present invention may be made of a high density foam, or a woven fabric material such as rags. In certain embodiments, the outer casing 13 may include an opening that may be opened and closed by a zipper 18. The zipper 18 may be secured to the rear surface 12. Therefore, the padding 20 may be removed and replaced.

It should be understood, of course, that the foregoing relates to exemplary embodiments of the invention and that modifications may be made without departing from the spirit and scope of the invention as set forth in the following claims.

What is claimed is:

1. A punching shield comprising:

an outer casing comprising:

a front surface;

a rear surface opposite the front surface, wherein the rear surface comprises a larger diameter than the front surface;

an angled surface running from an outer edge of the front surface to an outer edge of the rear surface; and a plurality of protrusions extending from the angled surface and radially disposed from the outer edge of the rear surface to the outer edge of the front surface, wherein a plurality of indents are formed therebetween; and a padding disposed within the outer casing.

2. The punching shield of claim 1, wherein the angled surface is disposed about an entire circumference of the front and rear surface.

3. The punching shield of claim 2, wherein the front surface, the rear surface and the angled surface form a frusto conical shape.

4. The punching shield of claim 1, wherein the front surface is substantially planar.

5. The punching shield of claim 1, wherein each of the plurality of indents comprises a half pipe shape.

6. The punching shield of claim 1, wherein the outer edge of the rear surface is angled towards the angled surface.

7. The punching shield of claim 6, further comprising a pair of handle straps secured to opposing sides of the outer edge of the rear surface.

8. The punching shield of claim 1, further comprising a pair of handle straps secured to the rear surface.

9. The punching shield of claim 1, wherein the padding is at least one of a foam and a woven fabric material.

10. The punching shield of claim 1, wherein the outer casing is leather.

* * * * *